United States Patent [19]

Johnson et al.

[11] Patent Number: 4,711,043

[45] Date of Patent: Dec. 8, 1987

[54] TRAINING DEVICE FOR KICKING A FOOTBALL OR SOCCER BALL

[76] Inventors: Dennis M. Johnson, 1038 Carrin Dr.; H. Skeet Surrency, 726 E. Jefferson St., both of Tallahassee, Fla. 32301

[21] Appl. No.: 913,932

[22] Filed: Oct. 1, 1986

[51] Int. Cl.[4] ..... A43B 23/00
[52] U.S. Cl. ..... 36/139
[58] Field of Search ..... 36/133, 139; 2/2, DIG. 11; 272/76, DIG. 5; 273/DIG. 17, DIG. 18

[56] References Cited

U.S. PATENT DOCUMENTS

| | | | |
|---|---|---|---|
| 543,086 | 7/1895 | Donovan | 272/DIG. 5 |
| 2,811,811 | 11/1957 | Faranda | 273/DIG. 18 |
| 3,866,909 | 2/1975 | DeSantis | 2/2 X |

*Primary Examiner*—Louis K. Rimrodt

[57] ABSTRACT

A device for training new players in the proper technique for power-kicking a soccer ball, or place-kicking or punting a football, using the principle of audible reinforcement. As the foot makes contact with the ball in the optimum location for maximum distance and accuracy, the training aid emits a sound. Mis-kicked balls do not cause the sound to be generated.

1 Claim, 6 Drawing Figures

TRAINING DEVICE FOR KICKING A FOOTBALL OR SOCCER BALL

BACKGROUND OF THE INVENTION

When kicking any object resting on the ground, the normal inclination is to approach the object head-on, and attempt to make contact with the toe of the shoe. While satisfactory for ensuring contact with the object itself, this method is not well suited for those athletic purposes when both distance and accuracy are important, such as power-kicking a soccer ball, or place-kicking a football, for two significant reasons:

(1) Owing to the nature of the approach, the momentum generated by the top of the leg (from hip to knee) is restricted, thereby limiting the amount of energy which can be transferred to the ball; and, (2) Owing to the small surface area of the foot which is brought into contact with the ball, the probability of mis-kicks is high.

By contrast, the ideal kicking technique for distance and accuracy would:

(1) Maximize the momentum generated by the top of the leg by swinging the leg around the front of the body to increase the length of the arc travelled by the foot; and, (2) Bring more surface area into contact with the ball by making the point of impact the top, rather than the toe, of the foot.

The embodiment of this technique is the diagonal approach and kicking style used in the most popular sport in the world: Soccer. Its superiority over other techniques is demonstrated by the almost total dominance within the past 20 years, of the so-called "sidewinder", or soccer style kicker, over the traditional head-on place-kicker in the American sport of football. Football coaches have come to recognize that the "sweet spot", or optimum area of the foot to bring into contact with the ball during a place-kick, is the same as for a punt: The top of the foot.

This kicking technique is one which must be learned. It does not come naturally. That is the reason why it was virtually unknown in American football until the popularity of soccer began to spread to this country.

Instructing new players in the proper technique for power-kicking a soccer ball, or place-kicking, or even punting, a football, is difficult because it is not possible for a coach to see each time precisely the point at which the moving foot contacts the ball.

The object of this invention is to provide a training aid which will overcome this inherent limitation of visual observation by incorporating a mechanism for emitting an audible signal whenever a ball is struck by the desired area of the foot.

A further object of this invention is to provide a means of self training through which the sound emitted whenever the kicked ball is struck by the desired area of the foot acts as audible reinforcement to the player.

A further object of this invention is to achieve any or all of these objectives by means of an accessory which will not interfere in the play of the game, and which could be used during play.

A further object of this invention is to achieve any or all of these objectives by means of an accessory which can easily be attached, and detached, from any lace-up shoe such as those typically encountered in athletics.

SUMMARY OF THE INVENTION

Accordingly, the present invention is an accessory intended to be attached to the shoe of a player in such a way as to position a sound emitting device over the area of the foot comprising the optimum point for contacting a football or soccer ball when kicking for distance and accuracy.

DETAILED DESCRIPTION OF THE PREFERRED EMBODIMENT

Figure 1:
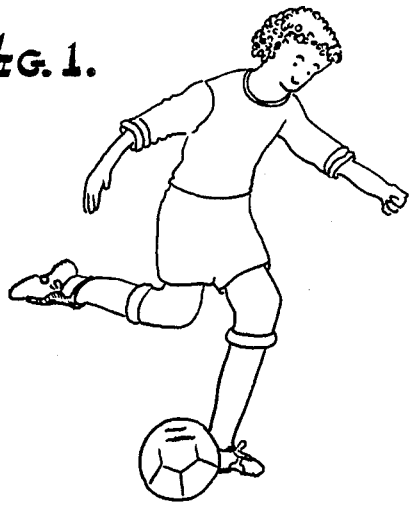
FIG. 1 is a plain side view of a player approaching a soccer ball using the proper technique for power and accuracy.

FIG. 1 shows the preferred embodiment of the invention being used, in this illustration, by a soccer player demonstrating the proper approach for power-kicking a soccer ball. The foot remains extended, as shown in the drawing, as it swings through its arc and contacts the ball in the area indicated by the target.

Figure 2:
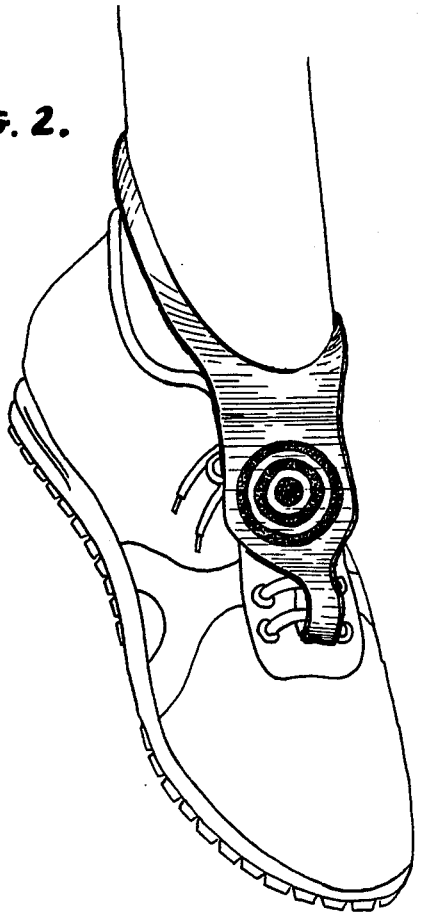
FIG. 2 is a plain top view of a typical athletic shoe showing the preferred embodiment of the invention attached.
Figure 3:
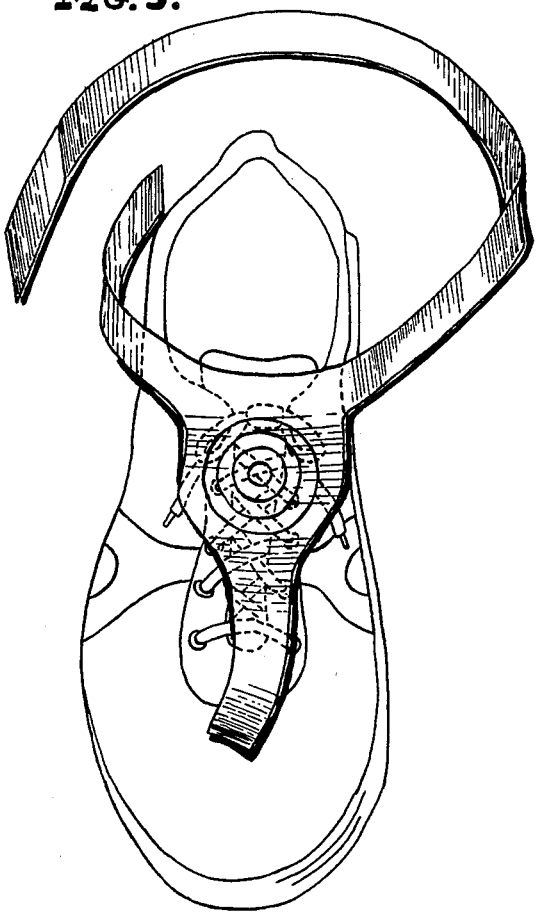
FIG. 3 is an overhead perspective showing the preferred emobdiment of the invention in relation to an athletic shoe.

FIGS. 2 and 3 show the preferred embodiment of the invention attached to a typical athletic shoe. The sound emitting device is located over the shoe laces, as indicated in these illustrations by the bull's eye target. The location of the sound emitting device, as represented by the bull's eye target, can be adjusted to any point up or down the length of the laces by means of an elastic adjusting flap wrapped around the bottom lace. Although not essential to the object of the invention itself, this capability of the preferred embodiment to adjust the location of the sound emitting device is desirable to accomodate differences in the sizes of feet, and variations in the styles of shoes. The optimum striking area for maximum distance and accuracy, and, consequently, the desired location for the sound emitting device, is that region of the foot where the shoe laces cross the medial longitudinal arch.

In FIGS. 2 and 3, the top of the invention is secured in place by two elastic flaps 5, 6 which extend behind the ankle and connect by means of a fastening material 7, 8 similar to the Velcro brand of fastening material. However, it is recognized that this connection could take many forms, including the use of snaps, or by eliminating the back flaps altogether, and extending the bottom flap so that it runs beneath the laces from bottom to top, and then wraps around the top lace to connect to the top of the invention. The preferred embodiment depicted in these drawings is shown for illustration only, and is not intended to be exclusive.

Figure 4:
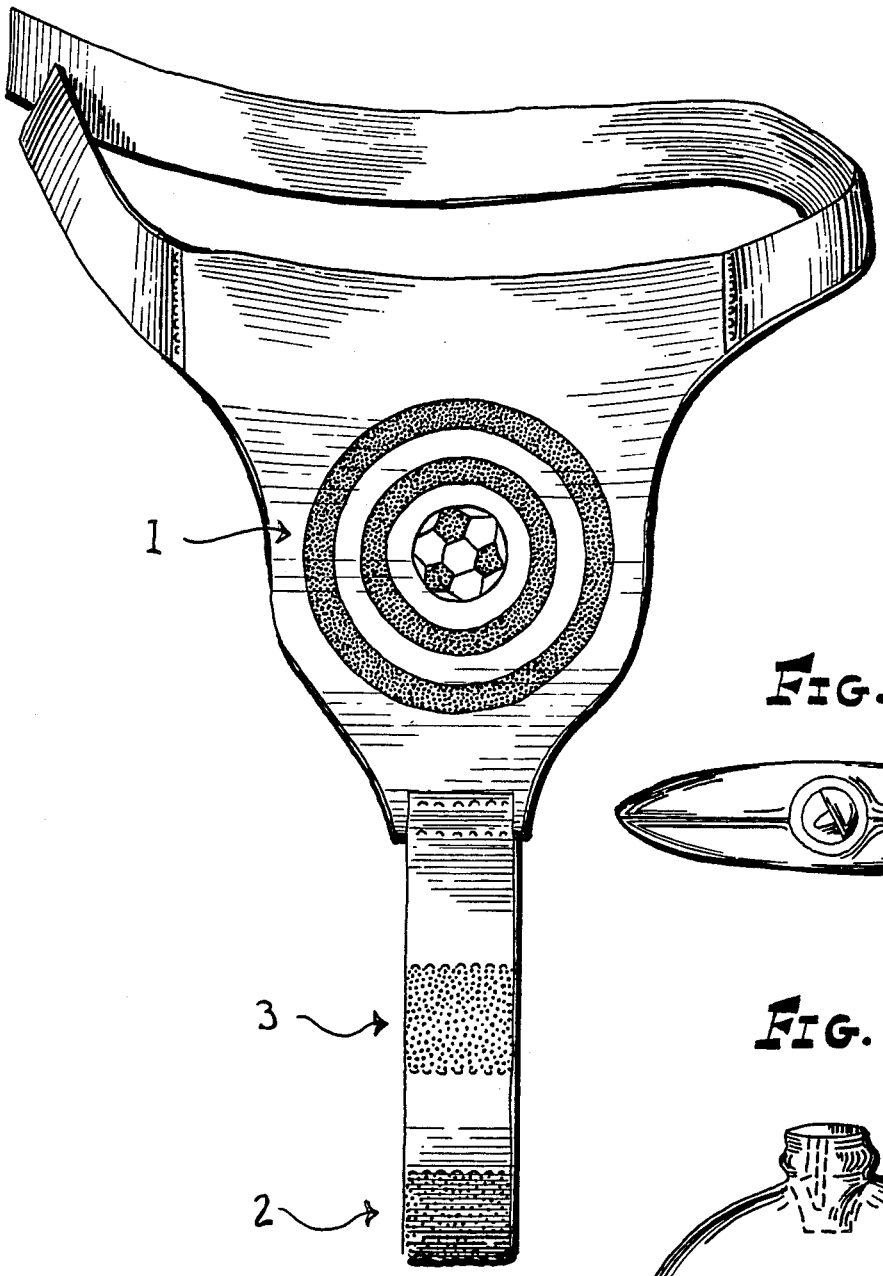
FIG. 4 is a plain front view of the preferred embodiment of the invention.

FIG. 4 shows a frontal view of the preferred embodiment of the invention. The main section support material 1 of the invention consists of two pieces of vinyl stitched or bonded together, and between which is secured the sound emitting device. In the preferred embodiment shown in the drawings, a bull's eye target appears on the face of this section of the invention, immediately over the location of the sound emitting device, to give the player a visual reference to the optimum kicking area. When a ball is kicked so that the point of impact is within this target area, an audible signal is produced.

It should be noted that section 1 could be composed of any material, including leather, rubber, cloth, etc., with the same sound emitting device enclosed within. It cound also be constructed in such a way that the sound emitting device is not covered at all. The present drawing of the preferred embodiment is for illustration only, and is not intended to be exclusive.

Areas 2 and 3 on the bottom elastic flap 4 are fastening materials similar to the Velcro brand of fastening material. In the preferred embodiment shown in the drawings, the elastic flap is designed to be wrapped around the bottom lace of the shoe, adjusted so as to position the target over the desired area of the foot, and then secured by means of the fastening material. Alternative embodiments might make use of other approaches such as snaps, ties, etc., to attach the device to the shoe. The method for attaching the device to the shoe is not critical to the invention itself. These drawings are for illustration only, and are not intended to be exclusive.

Figure 5:
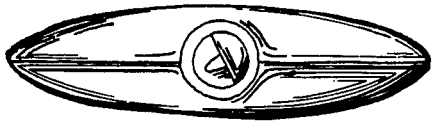
FIG. 5 is a plain top view of the preferred embodiment of a sound emitting device.
Figure 6:
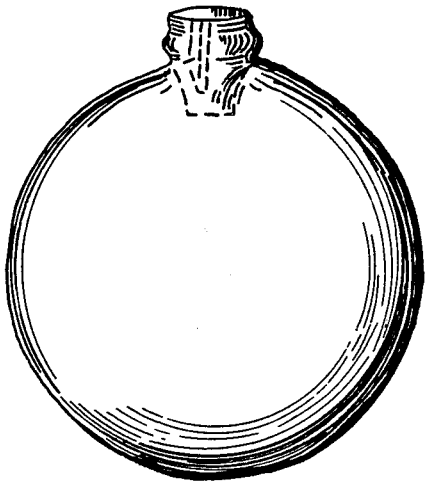
FIG. 6 is a plain side view of the preferred embodiment of a sound emitting divice.

FIGS. 5 and 6 represent top and side perspectives of the preferred embodiment of a non-mechanical sound emitting device. It consists of a resilient, molded plastic squeaker with a protruding neck into which is inserted a rigid plastic assembly enclosing metal reeds, similar to that which might be found in a child's squeeze toy. Sound is generated as air is forced over the reeds, causing them to vibrate.

The plastic reed assembly can be inserted into the protruding neck of the sneaker in either direction (e.g., with the open end of the reeds pointing outwardly, away from the squeaker; or inwardly, toward the squeaker). The sound generated by the device may thus be set to occur:

(1) Immdediately upon impact, as the force of the foot striking the ball expells air from the plastic squeaker over outwardly pointing reeds; or, (2) Shortly after impact, as the plastic squeaker expands back to its original shape, thereby drawing air over inwardly pointing reeds.

It is recognized that there are other non-mechanical, as well as mechanical, and electronic, devices which could be used to generate the audible signal. The preferred embodiment depicted in these drawings is for illustration only, and is not intended to be exclusive.

As these and other combinations, modifications, and substitutions of the features illustrated herein can be utilized without departing from the present invention as set forth in the appended claims, the foregoing description of the preferred embodiments should be understood by way of illustration rather than by way of limitations of the present invention.

What is claimed is:

1. An impact audible signal device adapted to be removably attached over the shoe lace of a soccer ball player's shoe, or the like, the combination of:

means for generating an audible signal upon impact with a ball; said means being attached to a support material; upper elastic flap means attached to the support material which are adapted to extend behind the ankle of a player and connect by fastening means; a bottom elastic flap means attached to the support material and designed to be wrapped around the bottom lace of a player's shoe and connected by fastening means; said means for generating an audible signal being adjustably secured to a shoe of a player by said upper and bottom flap means so as to position the signal means over the desired area of the shoe.

* * * * *